US009957027B2

(12) United States Patent
Blomdahl

(10) Patent No.: US 9,957,027 B2
(45) Date of Patent: May 1, 2018

(54) OUTBOARD DRIVE DEVICE

(71) Applicant: Cimco Marine AB, Angelholm (SE)

(72) Inventor: Andreas Blomdahl, Angelholm (SE)

(73) Assignee: CIMCO MARINE AB, Angelholm (SE)

( * ) Notice: Subject to any disclaimer, the term of this patent is extended or adjusted under 35 U.S.C. 154(b) by 0 days. days.

(21) Appl. No.: 15/132,759

(22) Filed: Apr. 19, 2016

(65) Prior Publication Data

US 2016/0229509 A1 Aug. 11, 2016

Related U.S. Application Data

(63) Continuation of application No. 14/191,072, filed on Feb. 26, 2014, now Pat. No. 9,511,840, which is a continuation of application No. 12/678,773, filed as application No. PCT/SE2007/050983 on Dec. 12, 2007, now Pat. No. 8,662,945.

(51) Int. Cl.

| | |
|---|---|
| ***B63H 20/14*** | (2006.01) |
| ***B63H 20/20*** | (2006.01) |
| *B63H 23/02* | (2006.01) |

(52) U.S. Cl.

CPC ..... *B63H 20/14* (2013.01); *B63H 20/20* (2013.01); *B63H 2023/0216* (2013.01); *Y10T 29/49826* (2015.01)

(58) Field of Classification Search

CPC ..... B63H 20/14; B63H 20/20

See application file for complete search history.

(56) References Cited

U.S. PATENT DOCUMENTS 2,722,193 A 11/1955 Brindley
4,382,797 A * 5/1983 Blanchard ..... B63H 5/1252 440/53
4,408,994 A 10/1983 Blanchard
(Continued)

FOREIGN PATENT DOCUMENTS

WO 9119643 A1 12/1991

OTHER PUBLICATIONS

International Patent Application No. PCT/SE2007/050983, International Search Report dated Aug. 26, 2008, 4 pages.

*Primary Examiner* — Andrew Polay
(74) *Attorney, Agent, or Firm* — Fredrikson & Byron, P.A.

(57) ABSTRACT

An outboard drive device (10) comprising a motor (11) having a crankshaft (16), wherein said outboard drive device (10) further comprises a propeller shaft (12) with a propeller which propeller is below the hull (13) of a boat when said outboard drive device (10) is operated, and a power coupling system for transferring power from the motor (11) to the propeller shaft (12). The motor (11) is an automotive motor or an industrial base engine, wherein the crankshaft (16) is substantially horizontal and substantially parallel to the propeller shaft (12) when said outboard drive device (10) is operated. The power coupling system comprises a power transfer device (17), a transmission (18) and a transmission drive shaft (19). The power transfer device (17) connects the crankshaft (16) with the transmission drive shaft (19) for transferring the output power from the crankshaft (16) to the transmission drive shaft (19). The transmission (18) comprises a forward gear (23) and a reverse gear (24), so that the output power is reversible.

18 Claims, 2 Drawing Sheets

(56) References Cited

U.S. PATENT DOCUMENTS

Figure 1:
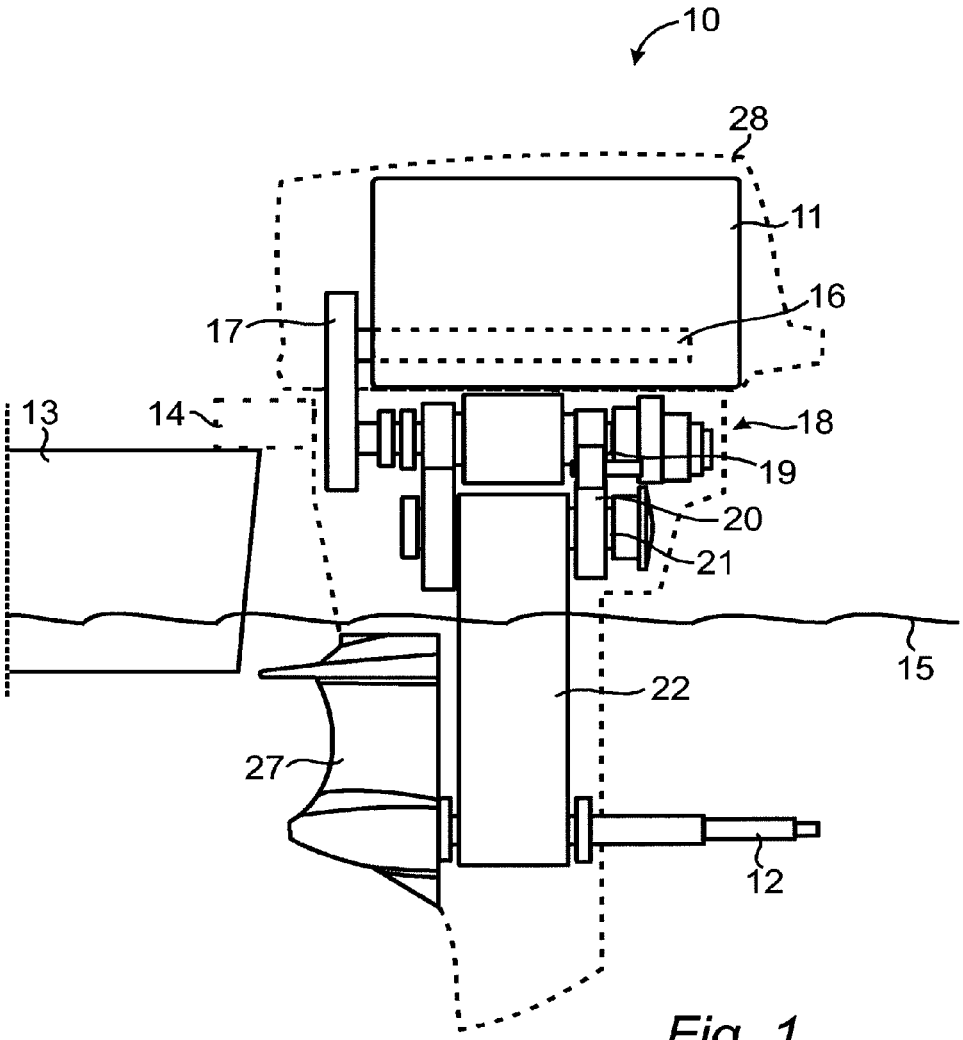

| | | | | |
|---|---|---|---|---|
| 4,559,018 | A | 12/1985 | Nakahama et al. | |
| 4,869,692 | A | 9/1989 | Newman et al. | |
| 4,887,983 | A | 12/1989 | Bankstahl et al. | |
| 4,925,413 | A | 5/1990 | Newman et al. | |
| 4,992,066 | A | 2/1991 | Watson et al. | |
| 5,178,566 | A | 1/1993 | Stojkov et al. | |
| 5,435,763 | A | 7/1995 | Pignata et al. | |
| 5,879,210 | A * | 3/1999 | Goto ..... | B63H 20/20 192/3.63 |
| 5,938,490 | A | 8/1999 | Rodler | |
| 5,961,358 | A | 10/1999 | Hardesty et al. | |
| 6,206,739 | B1 | 3/2001 | Dadd et al. | |
| 6,884,131 | B2 | 4/2005 | Katayama et al. | |
| 6,910,987 | B2 | 6/2005 | Richards | |
| 8,662,945 | B2 | 3/2014 | Blomdahl et al. | |
| 2006/0052014 | A1 | 3/2006 | Kobayashi | |
| 2006/0172630 | A1 | 8/2006 | Kawamoto | |
| 2006/0199451 | A1 | 9/2006 | Broussard | |
| 2014/0179179 | A1 | 6/2014 | Blomdahl | |
| 2015/0353177 | A1 | 12/2015 | Flodman et al. | |

* cited by examiner

OUTBOARD DRIVE DEVICE

RELATED APPLICATIONS

This application is a continuation application of U.S. application Ser. No. 14/191,072, filed Feb. 26, 2014, which is a continuation of U.S. application Ser. No. 12/678,773, filed Mar. 18, 2010, which is a 35 U.S.C. 371 national stage filing from International Application No. PCT/SE2007/050983, filed Dec. 12, 2007, the teachings of which are incorporated herein by reference.

FIELD OF THE INVENTION

The present invention relates to an outboard drive device for a boat. More specifically the present invention relates to an outboard drive device comprising an outboard motor having a crankshaft, a propeller which is below the hull of the boat when said outboard drive device is operated, and a power coupling system for transferring power from the motor to the propeller. In an outboard drive device the motor and the power coupling system are arranged outside the boat or outside the hull of the boat.

PRIOR ART

A plurality of outboard drive devices and outboard motors for boats are disclosed in the prior art. Conventionally, such outboard drive devices comprise an outboard motor arranged in a housing in a top portion of the outboard drive device. A crank shaft of said outboard motor extends substantially vertically down to a propeller shaft arranged in a lower portion of the outboard drive device. The propeller shaft is substantially horizontal when said outboard drive device is operated. For example, the vertical crankshaft is connected to the horizontal propeller shaft by means of bevel gears for transferring torque from the vertical crankshaft to the horizontal propeller shaft.

Another type of outboard drive device is disclosed in U.S. Pat. No. 4,559,018. This document discloses an outboard drive device comprising an outboard motor having a crankshaft extending substantially horizontally. The crankshaft is connected to a horizontal propeller shaft through a vertically extending drive shaft and bevel gears. According to U.S. Pat. No. 4,559,018 a forward/reverse/neutral transmission can be arranged between the crankshaft and the vertical drive shaft.

Another type of outboard drive device is disclosed in U.S. Pat. No. 5,938,490. This document discloses an outboard propulsion system comprising an outboard motor having a horizontal crankshaft connected to a waterjet through a belt.

One problem with such prior art outboard drive devices is that they are ineffective and expensive.

BRIEF DESCRIPTION OF THE INVENTION

One object of the present invention is to overcome the above-mentioned problem. The outboard drive device according to the present invention provides an efficient and strong power transmission. Simultaneously the outboard drive device according to the invention makes it possible to use standardized types of engines, such as various types of automotive engines or industrial base engines. Simultaneously, the invention makes it possible to obtain a hydrodynamic design of the outboard drive device.

Hence, the present invention relates to an outboard drive device comprising an outboard motor having a crankshaft, wherein said outboard drive device further comprises a propeller which propeller is below the hull of a boat when said outboard drive device is operated, and a power coupling system for transferring power from the motor to the propeller, characterised in that the power coupling system comprises a power transfer device for transferring output power from the crankshaft to a transmission drive shaft of a transmission, and a power transfer means for transferring output power from the transmission to a drive shaft of an endless loop flexible drive coupling operatively connecting said transmission to a propeller shaft for driving said propeller, wherein the crankshaft is substantially horizontal and substantially parallel to the propeller shaft when said outboard drive device is operated. Hence, the crankshaft is substantially horizontal and extends along the longitudinal direction of the boat or in the direction of travel. The substantially horizontal and parallel shafts are easily connected by means of vertically extending gear wheels, chains, belts or similar without the need for any vertically extending shafts or bevel gears, wherein the invention results in an efficient and strong power transmission. The position of the shafts also makes it possible to use an automotive motor or similar instead of a motor having a vertical crankshaft. Further, the position of the shafts in combination with the endless loop flexible drive coupling makes it possible to form an outboard drive device having excellent hydrodynamic properties as the outboard drive device can be made very narrow.

The transmission drive shaft and the shaft of the endless loop flexible drive coupling can be arranged substantially in parallel with the crankshaft. Further the crankshaft, the transmission drive shaft, the shaft of the endless loop flexible drive coupling and the propeller shaft can be distributed along a common vertical plane to obtain a suitable distance between the shafts, wherein all shafts can be arranged substantially horizontally, in parallel and in a common vertical plane when the outboard drive device is operated. A person skilled in the art being guided by the description of the invention would of course recognize that the shafts can be somewhat angled in relation to each other and that the term substantially horizontal, substantially in parallel and substantially vertical as used herein includes such deviations and that such deviations are included in the scope of protection. For example, the angle between the crankshaft, the transmission drive shaft, the shaft of the endless loop flexible drive coupling and/or the propeller shaft is less than 20°, suitably less than 10° and for example less than 5°.

According to one embodiment of the present invention a structure is arranged for pinching legs of the endless loop flexible drive coupling together to reduce the cross-section of the drive device below the water line to reduce drag. Said structure can comprise curved surfaces bending the path of travel of the legs of the endless loop flexible drive coupling together to obtain a narrow and concave structure of the endless loop flexible drive coupling. For example, the endless loop flexible drive coupling is formed by one or more belts or chains or similar.

For example, the crankshaft and the transmission drive shaft extend from a first side of the power transfer device, wherein one end of the crankshaft and the transmission drive shaft are connected to the power transfer device. For example, the power transfer device is arranged towards the stern of the boat when the outboard drive device is mounted, wherein the crankshaft and the transmission drive shaft extend along the boat and projects from only one side of the power transfer device and away from the stern.

The motor can be interchangeable and can be arranged in a motor housing for receiving various types of motors having or being connected to a crankshaft which is substantially horizontal when the outboard drive device is operated. The motor can be an automotive engine or an industrial base engine, such as a standardized car engine or truck engine having a horizontal crankshaft.

The present invention also relates to the use of an automotive engine having a horizontal crankshaft as an outboard motor for driving a propeller in an outboard drive device in which the crankshaft is horizontal when the outboard drive device is operated and which outboard drive device includes a power coupling system comprising a power transfer device for transferring output power from the crankshaft to a transmission drive shaft of a transmission, and a power transfer means for transferring output power from the transmission to a drive shaft of an endless loop flexible drive coupling operatively connecting said transmission to a propeller shaft for driving said propeller.

The present invention also relates to the use of an industrial base engine having a horizontal crankshaft as an outboard motor for driving a propeller in an outboard drive device in which the crankshaft is horizontal when the outboard drive device is operated and which outboard drive device includes a power coupling system comprising a power transfer device for transferring output power from the crankshaft to a transmission drive shaft of a transmission, and a power transfer means for transferring output power from the transmission to a drive shaft of an endless loop flexible drive coupling operatively connecting said transmission to a propeller shaft for driving said propeller.

The present invention also relates to a method of manufacturing an outboard drive device, comprising the steps of a) arranging a transmission in a drive housing and connecting a transmission shaft to a shaft for driving an endless loop flexible drive coupling by means of a power transfer means, b), arranging a propeller shaft so that it extends through an aperture in said drive housing, c) connecting said propeller shaft and said shaft for driving the endless loop flexible drive coupling by means of said endless loop flexible drive coupling, d) after steps a to c locating a motor in an outboard motor housing, so that a crankshaft of said motor is arranged substantially horizontally and substantially parallel to the propeller shaft when said outboard drive device is operated, and e) connecting said crankshaft to the transmission drive shaft of said transmission by means of a power transfer device.

Hence, the outboard drive device is assembled in a favourable and cost efficient manner. For example, the drive housing can be provided with the power coupling system, such as the transmission with the transmission shaft, the power transfer means, the drive shaft of the endless loop flexible drive coupling, the endless loop flexible drive coupling and the propeller shaft and, optionally, the propeller. Additionally, also the power transfer device can be connected to the transmission drive shaft. Then said drive housing with the power coupling system can be stored and transported to a motor manufacturer or a motor assembly facility without any motor or motor housing. Then the drive housing with the power coupling system can be connected to any suitable motor having a horizontal crankshaft as described above, and said motor can be mounted at any desired location.

Further characteristics and advantages of the present invention will become apparent from the description of the embodiments below, the appended drawings and the dependent claims.

SHORT DESCRIPTION OF THE DRAWINGS

Figure 2:
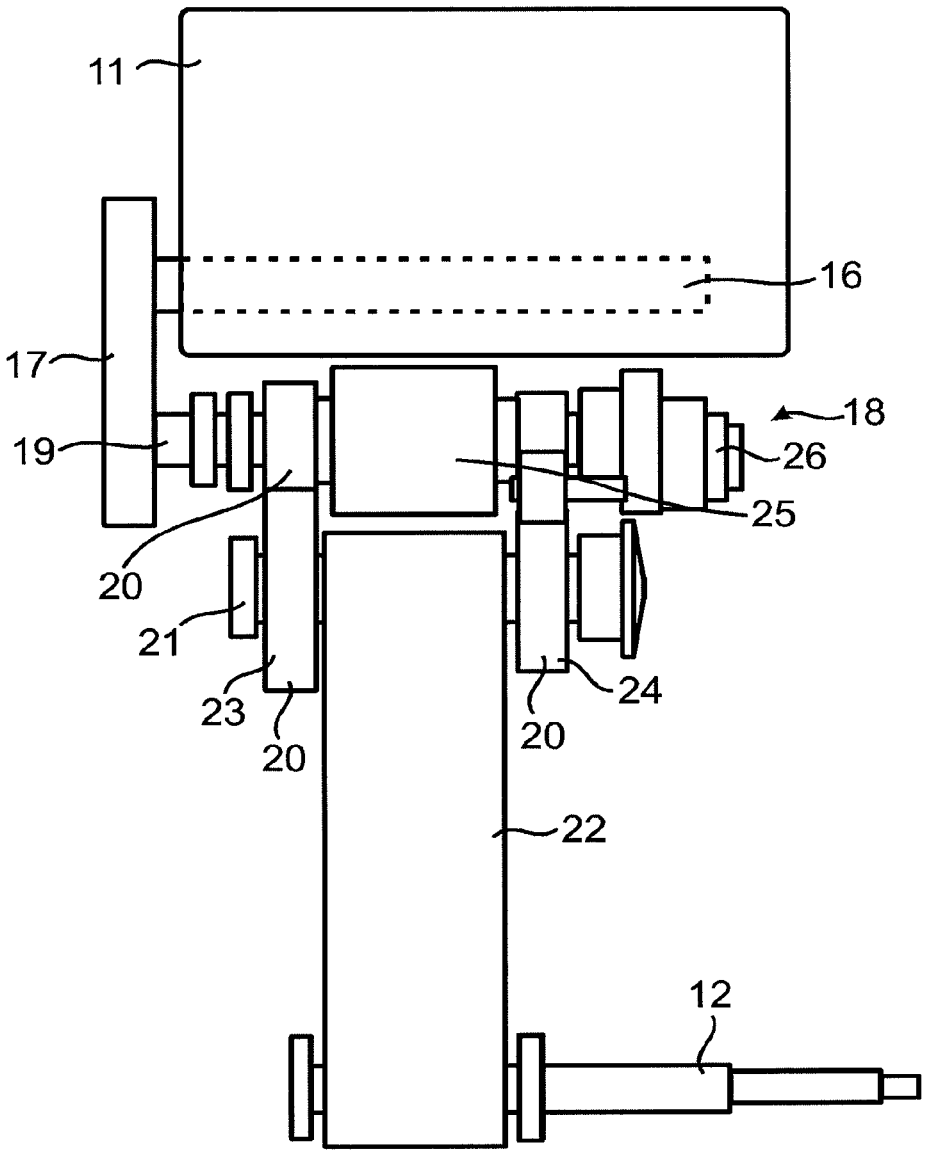

The invention will now be described in more detail with the aid of exemplary embodiments and with reference to the accompanying drawings, in which FIG. 1 is a schematic side view of an outboard drive device according to an embodiment of the invention, wherein a drive housing of the outboard drive device is partially illustrated by means of a dashed line, and wherein the outboard drive device is fastened to the stern of a boat and partially immersed in water, and FIG. 2 is a schematic side view of the outboard drive device without said drive housing.

THE INVENTION

The invention will now be described in more detail by means of an embodiment example and with reference to the enclosed drawings, which are schematic views of an outboard drive device 10 according to one embodiment of the invention. The outboard drive device 10 comprises an outboard motor 11, a propeller shaft 12 for driving a propeller (not showed) and a power coupling system for transferring power from the motor 11 to the propeller shaft 12. The outboard drive device 10 is arranged to be connected to the hull 13 of a boat, so that the outboard drive device 10 is arranged outside the hull 13, wherein the motor 11 and the power coupling system are arranged outside the boat or outside the hull 13 of the boat. For example, the outboard drive device comprises conventional fastening means 14 for fastening the outboard drive device 10 to the stern of the hull 13. For example, the fastening means 14 comprises or is provided with a trim/tilt system, such as a hydraulic or electric trim/tilt system. For example, the trim/tilt system is conventional.

When the outboard drive device 10 is operated the propeller shaft 12 and the propeller is arranged below the water line 15 and below the hull 13. Hence, the outboard drive device 10 is arranged to project a distance into the water when operated, so that the propeller and the lower portion of the outboard drive device 10 is immersed in the water, so that the water line 15 is arranged above the propeller.

The motor 11 comprises a crankshaft 16 for output power. The crankshaft 16 is illustrated by means of dashed lines in the drawings. The crankshaft 16 extends substantially horizontally when the outboard drive device 10 is operated. In view of the invention as disclosed, a person skilled in the art would recognize that the crankshaft can be somewhat angled. In this context, substantially horizontally includes deviations from the horizontal plane with for example less than 10°, suitably less than 5° and preferably less than 2°. For example the crankshaft 16 is arranged with an angle of less than 10° and preferably less than 5°. For example the crankshaft 16 is horizontal. The crankshaft 16 is arranged substantially parallel to the propeller shaft 12 when said outboard drive device 10 is operated. For example the angle between the crankshaft 16 and the propeller shaft 12 is less than 20°, suitably less than 10° and preferably less than 5°. Hence, the crankshaft 16 is arranged lengthwise with the boat, wherein the crankshaft 16 extends along the longitudinal axis of the boat. Hence, the motor 11 comprises or is connected to a substantially horizontal crankshaft 16.

According to one embodiment of the present invention the motor 11 is an automotive engine or an industrial base engine.

The power coupling system comprises a power transfer device 17, a transmission 18 having a transmission drive shaft 19, a power transfer means 20, a drive shaft 21 of an endless loop flexible drive coupling 22, the endless loop flexible drive coupling 22 and the propeller shaft 12. The power transfer device 17 connects the crankshaft 16 with the transmission drive shaft 19 for transferring the output power from the crankshaft 16 to the transmission drive shaft 19. The power transfer device 17 comprises for example a belt, chain or gears connecting the crankshaft 16 with the transmission drive shaft 19. For example, the power transfer device 17 extends substantially vertical.

The transmission 18 comprises a forward gear 23 and a reverse gear 24 connecting the transmission drive shaft 19 and the drive shaft 21 of the endless loop flexible drive coupling 22 and thus forming the power transfer means 20 for transferring power to the drive shaft 21 of the endless loop flexible drive coupling 22. For example, the transmission 18 comprises a forward, neutral and reverse gears. According to one embodiment of the invention the transmission 18 also includes additional gears or similar to change the ratio of the rotational speed of the propeller with respect to the rotational speed of the crankshaft 16. Hence, the outboard drive device 10 is arranged with a transmission 18 so that the output power is reversible, wherein the propeller can be driven in a forward mode as well as a reverse mode. For example, the reverse gear 24 comprises an idler gear or a belt drive.

The power coupling system according to one embodiment of the invention also comprises a clutch 25 having a clutch housing with clutch discs connected to a hydraulic pump 26 for the clutch 25. The clutch 25 is for example arranged as a dog clutch, automotive clutch any other conventional or special type of clutch.

The crankshaft 16 and the transmission drive shaft 19 extend from a first side of the power transfer device 17. For example, one end of the crankshaft 16 and one end of the transmission drive shaft 19 are connected to the power transfer device 17, wherein the crankshaft 16 and the transmission drive shaft 19 terminates at the power transfer device 17 and projects in the opposite direction. For example, the power transfer device 17 is arranged towards the hull 13 or the stern, wherein the crankshaft 16 and the transmission drive shaft 19 project away from the stern.

The power transfer means 20 connects the transmission 18 with the drive shaft 21 of the endless loop flexible drive coupling 22, wherein the endless loop flexible drive coupling 22 transfers the output power from the transmission 18 to the propeller drive shaft 12. The endless loop flexible drive coupling is for example formed by at least one belt or at least one chain. For example, the endless loop flexible drive coupling 22 is a toothed belt.

The outboard drive device 10 comprises a drive housing 27 for receiving the power coupling system and a motor housing 28 for receiving the outboard motor 11. The drive housing 27 is partially illustrated by means of dashed lines in FIG. 1 and has been removed in FIG. 2. The drive housing 27 provides functions of structural support, spacing and enclosing for the power coupling system and also supports the propeller through the propeller shaft 12 being supported by the drive housing 27. The drive housing 27 is connected to a structure for pinching legs of the endless loop flexible drive coupling 22 together to reduce the cross-section of the outboard drive device 10 below the water line 15 to reduce drag. For example, said structure comprises curved surfaces bending the path of travel of the legs of the endless loop flexible drive coupling 22 together. Further, according to one embodiment of the present invention the drive housing 27 is formed for containing oil for the endless loop flexible drive coupling 22. Hence, the endless loop flexible drive coupling 22 is running in a partially oil filled housing. According to one embodiment of the invention the drive housing is formed with a water inlet or a water pickup for cooling. The drive housing 27 is, for example, formed in a composite material or any other suitable material.

The motor housing 28 is illustrated by means of dashed lines in FIG. 1 and has been removed in FIG. 2. The motor housing 28 is arranged for receiving a motor 11 having a horizontal crankshaft 16 or a crankshaft 16 that is substantially horizontal when the outboard drive device 10 is operated. The motor housing 28 is formed for receiving an automotive engine or an industrial base engine. The motor housing 28 is formed for receiving different kinds of motors having a horizontal crankshaft.

According to one embodiment of the invention the crankshaft 16, transmission shaft 19, drive shaft 21 of the endless loop flexible drive coupling 22 and the propeller shaft 12 are horizontal or substantially horizontal. For example, the crankshaft 16, the transmission drive shaft 19, the drive shaft 21 of the endless loop flexible drive coupling 22 and the propeller shaft 12 are arranged in parallel or substantially in parallel. According to further one embodiment the crankshaft 16, transmission shaft 19, drive shaft 21 of the endless loop flexible drive coupling 22 and the propeller shaft 12 are distributed along a common vertical plane.

According to one embodiment of the invention the power coupling system for transferring power from the motor 11 to the propeller is positioned in the drive housing 27. Hence, the transmission 18, the drive shaft 21 of the endless loop flexible drive coupling 22 and the endless loop flexible drive coupling 22 is positioned in the drive housing 27. For example, the transmission drive shaft 19 and the drive shaft 21 of the endless loop flexible drive coupling 22 is positioned substantially horizontally. The propeller shaft 12 is positioned partially in the drive housing 27, wherein a portion thereof projects out from the drive housing 27 for carrying the propeller. For example, the propeller shaft is positioned substantially horizontally in a conventional manner. The transmission drive shaft 19 is connected to the drive shaft 21 of the endless loop flexible drive coupling 22 by means of the power transfer means 20, and the endless loop flexible drive coupling 22 is connected to the propeller shaft 12. For example, the power transfer means 20 and the endless loop flexible drive coupling 22 are positioned so that they extend substantially vertically. Then the drive housing 27 with the power coupling system is packed and transported to a motor mounting facility, where the motor 11 is mounted, so that the crankshaft 16 is positioned substantially horizontally. Hence, the drive housing 27 and the power coupling system is stored and transported without the motor 11 and optionally without the propeller. The crankshaft 16 is then connected to the transmission drive shaft 19 by means of the power transfer device 17, wherein the power transfer device 17 is positioned so that it extends substantially vertically. Then, the motor housing 28 and the propeller is mounted.

The invention claimed is:

1. An outboard drive device comprising: a motor having a crankshaft; a propeller shaft with a propeller below the hull of a boat when said outboard drive device is operated; and a power coupling system for transferring power from the motor to the propeller shaft, the power coupling system comprising a power transfer device and a transmission with a transmission drive shaft; wherein the power transfer device connects the crankshaft with the transmission drive shaft for transferring output power from the crankshaft to the transmission drive shaft, the transmission comprises a forward gear and a reverse gear, so that the output power is reversible, the transmission is arranged below a bottom of the motor and between the crankshaft and the propeller shaft, the transmission being operably coupled to the propeller shaft for transferring the output power from the transmission drive shaft to the propeller shaft, each of the crankshaft and the transmission driveshaft and the propeller shaft being substantially horizontal, the crankshaft and the transmission drive shaft and the propeller shaft being and remaining substantially parallel vertically as the outboard drive device, used in propelling the boat, is shifted from one position to another in steering the boat.

2. The device of claim 1, wherein the power transfer device extends in a substantially vertical direction between the crankshaft and the transmission drive shaft.

3. The device of claim 1, wherein the transmission drive shaft extends in a substantially horizontal direction between the power transfer device and the forward and reverse gears.

4. The device of claim 1, wherein the transmission drive shaft is arranged in parallel with the crankshaft and the propeller shaft and is vertically displaced below the crankshaft.

5. The device of claim 1, wherein the forward and reverse gears are situated on the transmission drive shaft, and wherein the clutch is situated on the transmission drive shaft so as to be centrally located between the forward and reverse gears on the transmission drive shaft.

6. The device of claim 1, wherein the clutch is connected to a hydraulic pump.

7. The device of claim 1, wherein the crankshaft and the transmission drive shaft extend from a first side of the power transfer device.

8. The device of claim 1, wherein the motor is an automotive motor or an industrial base engine.

9. A boat comprising a hull and an outboard drive device of claim 1, wherein the motor and the power coupling system are arranged outside the hull of the boat.

10. A method of manufacturing an outboard drive device, comprising the steps of a) arranging a transmission comprising a forward gear, a reverse gear, and a clutch in a drive housing; b), arranging a propeller shaft so that it extends through an aperture in said drive housing; c) after steps a and b locating a motor in an outboard motor housing, so that a crankshaft of said motor is arranged substantially horizontally and substantially parallel to the propeller shaft when said outboard drive device is operated; and d) connecting said crankshaft to a transmission drive shaft of said transmission by means of a power transfer device, wherein each of the crankshaft and the transmission driveshaft and the propeller shaft are substantially horizontal and wherein the crankshaft and the transmission drive shaft and the propeller shaft are and remain substantially parallel vertically as the outboard drive device, used in propelling the boat, is shifted from one position to another in steering the boat.

11. The method of claim 10, further comprising the step of arranging the transmission drive shaft to extend in a substantially horizontal direction between the power transfer device and the forward and reverse gears.

12. The method of claim 10, further comprising the step of arranging the transmission between the crankshaft and the propeller shaft.

13. The method of claim 10, wherein the forward and reverse gears are situated on the transmission drive shaft, and wherein the clutch is situated on the transmission drive shaft so as to be centrally located between the forward and reverse gears on the transmission drive shaft.

14. The method of claim 10, further comprising the step of arranging the power transfer device to extend in a substantially vertical direction between the crankshaft and the transmission drive shaft.

15. The device of claim 1, wherein each of the crankshaft and the transmission driveshaft and the propeller shaft remain substantially aligned when shifted in position as the outboard drive device is used.

16. The device of claim 15, wherein each of the crankshaft and the transmission driveshaft and the propeller shaft remain substantially aligned vertically.

17. The method of claim 10, wherein each of the crankshaft and the transmission driveshaft and the propeller shaft remain substantially aligned when shifted in position during use of the outboard drive device.

18. The method of claim 17, wherein each of the crankshaft and the transmission driveshaft and the propeller shaft remain substantially aligned when shifted in position during use of the outboard drive device.

* * * * *